US011248869B2

(12) United States Patent
Lopata et al.

(10) Patent No.: US 11,248,869 B2
(45) Date of Patent: Feb. 15, 2022

(54) ADJUSTABLE TRIGGER ASSEMBLY

(71) Applicant: Cor34, LLC, Bethel, CT (US)

(72) Inventors: Larry Lopata, Newtown, CT (US); Sylvio Lorenzut, Lagrangeville, NY (US); Zachary Sniffen, Norwalk, CT (US)

(73) Assignee: COR34 LLC, Bethel, CT (US)

( * ) Notice: Subject to any disclaimer, the term of this patent is extended or adjusted under 35 U.S.C. 154(b) by 563 days.

(21) Appl. No.: 15/670,591

(22) Filed: Aug. 7, 2017

(65) Prior Publication Data

US 2019/0041150 A1 Feb. 7, 2019

(51) Int. Cl.
*F41A 19/10* (2006.01)

(52) U.S. Cl.
CPC ..... *F41A 19/10* (2013.01)

(58) Field of Classification Search
CPC ..... F41A 19/10; F41A 19/16; F41A 19/15; F16B 37/14
USPC ..... 42/69.02
See application file for complete search history.

(56) References Cited

U.S. PATENT DOCUMENTS 3,206,884 A * 9/1965 Purvis ..... F41A 19/16 42/69.02
3,298,272 A * 1/1967 Henderson ..... F16B 37/14 411/373
3,529,508 A * 9/1970 Cooksey ..... A47G 3/00 411/374
4,691,461 A * 9/1987 Behlert ..... F41A 19/16 42/69.01
5,017,068 A * 5/1991 Cooksey ..... F16B 23/0061 411/373
5,822,903 A * 10/1998 Davis, Sr. ..... F41A 19/16 42/69.01
6,164,001 A * 12/2000 Lee ..... F41A 19/10 42/69.01
6,298,594 B1 * 10/2001 Strayer ..... F41A 19/10 42/69.01
6,651,642 B1 * 11/2003 Powers ..... F41B 5/1469 124/31
7,010,878 B1 * 3/2006 du Plessis ..... F41A 19/10 42/69.01
9,279,442 B2 * 3/2016 Naylor ..... F16B 37/14
9,618,028 B2 * 4/2017 Marczynski ..... F16B 1/0071
9,970,724 B1 * 5/2018 Acker ..... F41A 17/46
2008/0263926 A1 * 10/2008 Bubits ..... F41A 17/72 42/69.02
2012/0117841 A1 * 5/2012 Joubert ..... F41A 19/10 42/69.01
2013/0269233 A1 * 10/2013 Chin ..... F41A 11/00 42/69.01
2014/0068989 A1 * 3/2014 Bender ..... F41A 19/10 42/69.01

* cited by examiner

*Primary Examiner* — Bret Hayes
(74) *Attorney, Agent, or Firm* — Blue Capital Law Firm, P.C.

(57) ABSTRACT

The present disclosure provides a system and method for adjusting the normal resting position of a trigger for a firearm. The system and method allow for further customization of the fit of the firearm by moving the resting position of the trigger forward to accommodate shooters with larger hands and moving the resting position of the trigger rearward to accommodate shooters with smaller hands.

8 Claims, 17 Drawing Sheets

ADJUSTABLE TRIGGER ASSEMBLY

BACKGROUND

Firearms come in many models, shapes and sizes. One factor in firearms selection is the fit. The shooter's hand size is a primary factor in determining what models fits the shooter. It has become common for shooters to replace the stock grips with aftermarket grips to customize the fit. To further customize the fit it would be desirable to also adjust the normal resting position of the trigger within the trigger guard.

SUMMARY

The present disclosure provides a system and method for adjusting the normal resting position of a trigger for a firearm. The system and method allow for further customization of the fit of the firearm by moving the resting position of the trigger forward to accommodate shooters with larger hands and moving the resting position of the trigger rearward to accommodate shooters with smaller hands.

DETAILED DESCRIPTION

Referring to the FIGS., several embodiments of the trigger assembly according to the principles of the present disclosure are described in further detail. The trigger assembly is generally shown and described herein with reference to a 1911 style handgun; however, it should be appreciated that the embodiments of the trigger according to the present disclosure can be adapted to be used in many different types of firearms (e.g., shotguns, rifles, and handgun styles other than the 1911). The disclosure herein is not intended to limit the applicability of the present disclosure to trigger for a particular firearm style.

Referring to FIGS. 1-7 generally, an adjustable trigger assembly according to principles of the present disclosure is described herein. In the depicted embodiment, the adjustable trigger is configured to adjust the location of the resting position or natural un-pulled position of the trigger. It should be appreciated that other aspects of the trigger could also be adjusted. For example, the trigger travel (the distance the trigger moves rearward from its resting position to its firing position) can also be independently adjusted.

Figure 1:
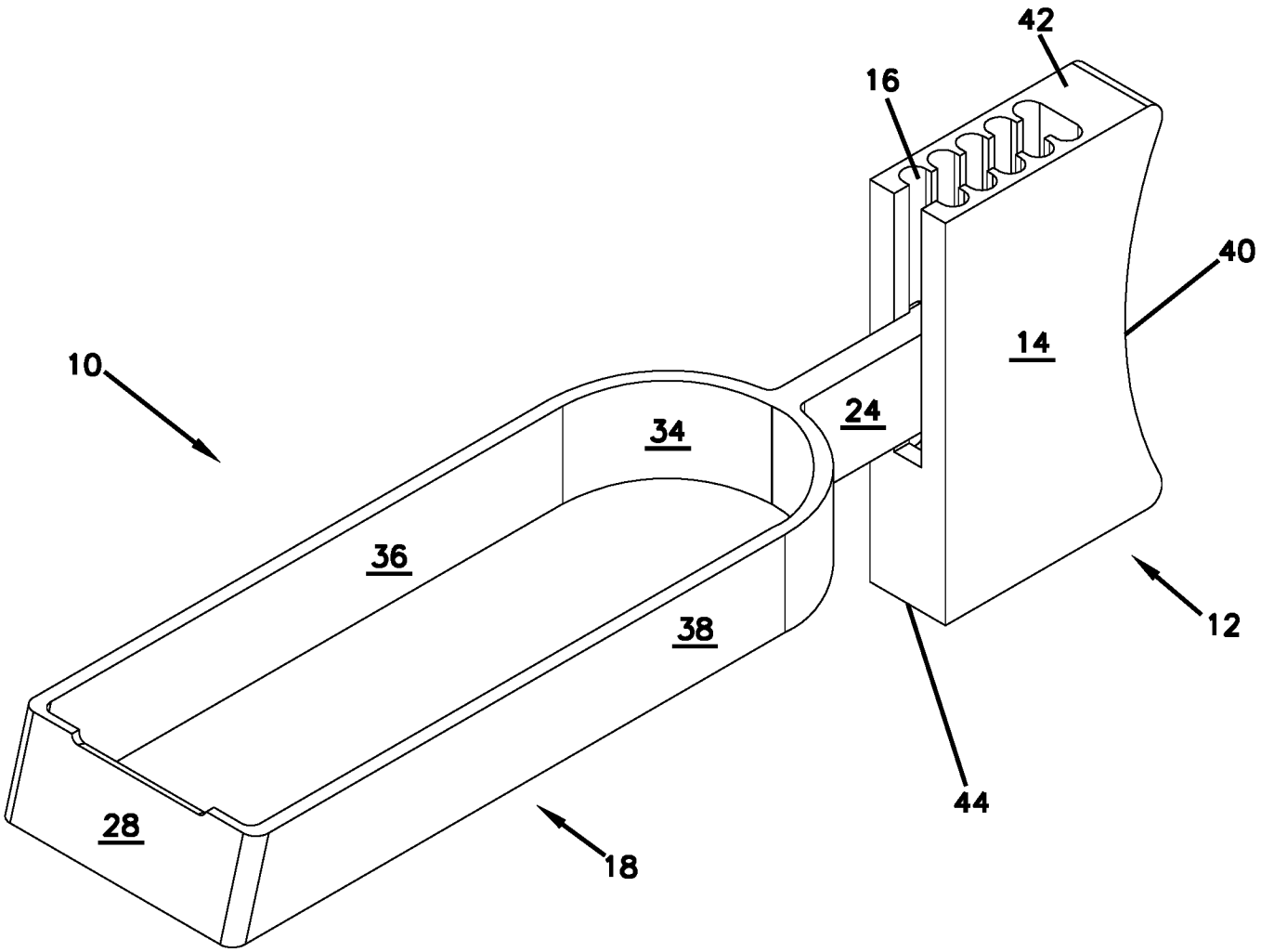
FIG. 1 is a perspective view of an embodiment of an adjustable trigger assembly according to principles of the present disclosure.
Figure 2:
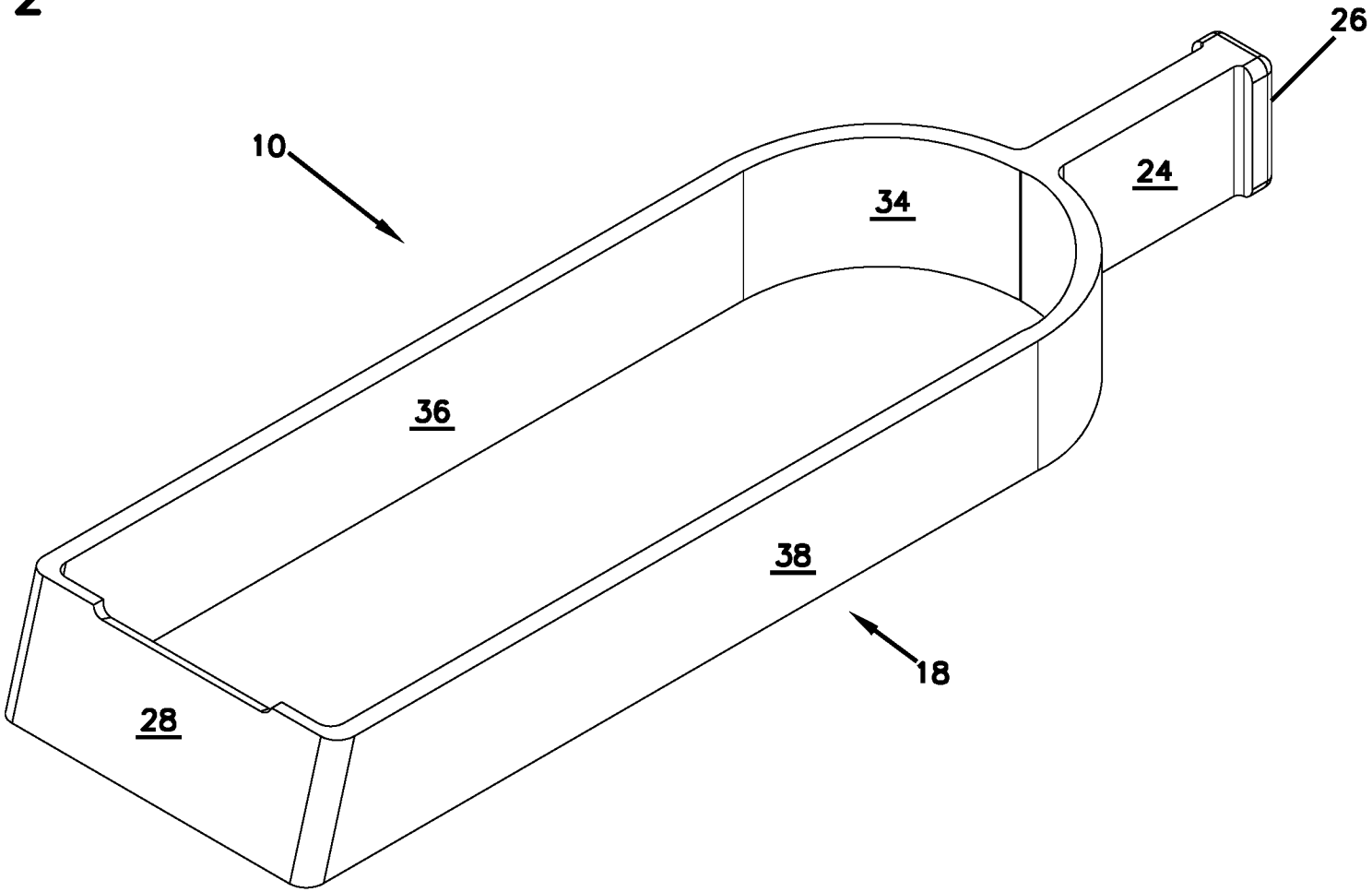
FIG. 2 is a perspective view of a first component of the trigger assembly of FIG. 1.
Figure 3:
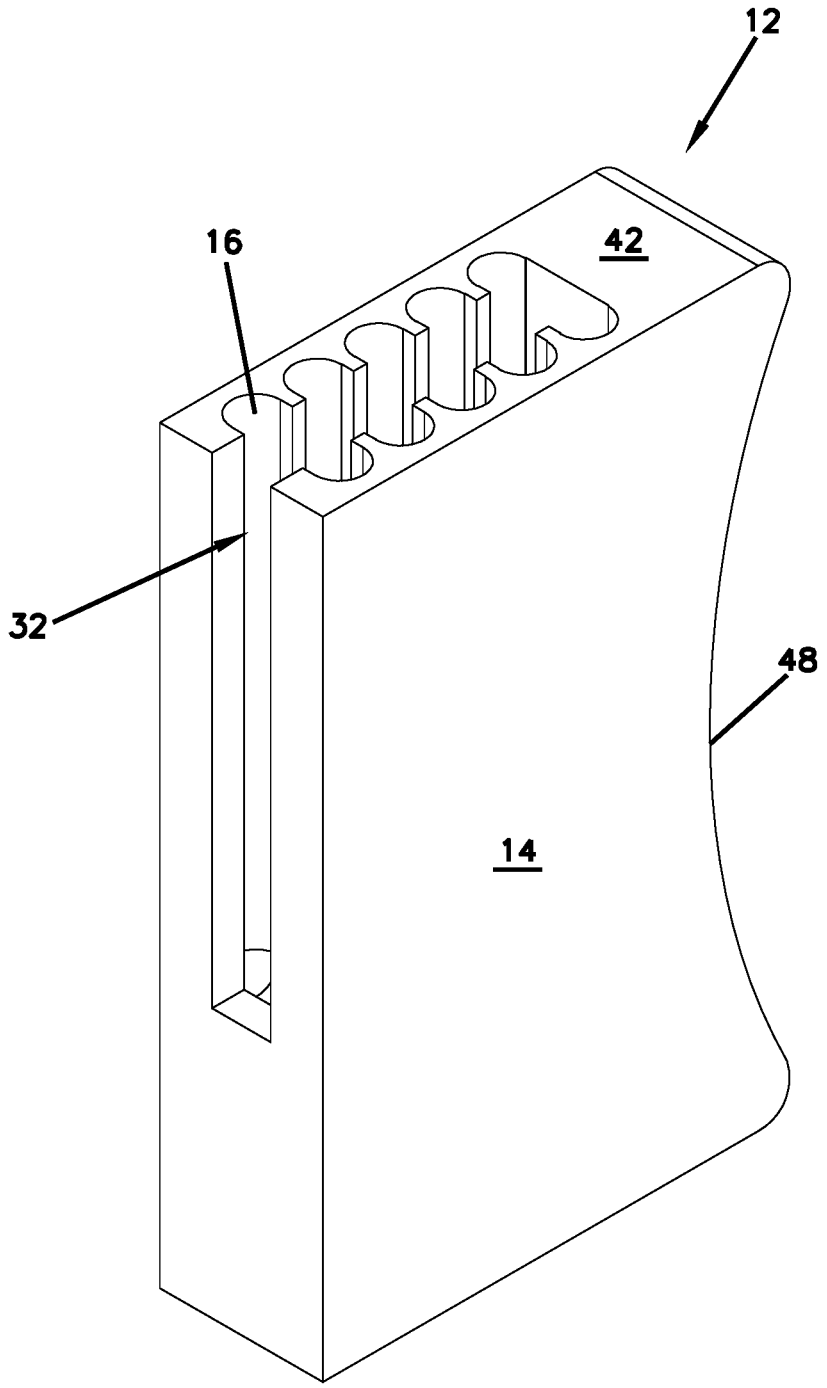
FIG. 3 is a perspective view of a second component of the trigger assembly of FIG. 1.
Figure 4:
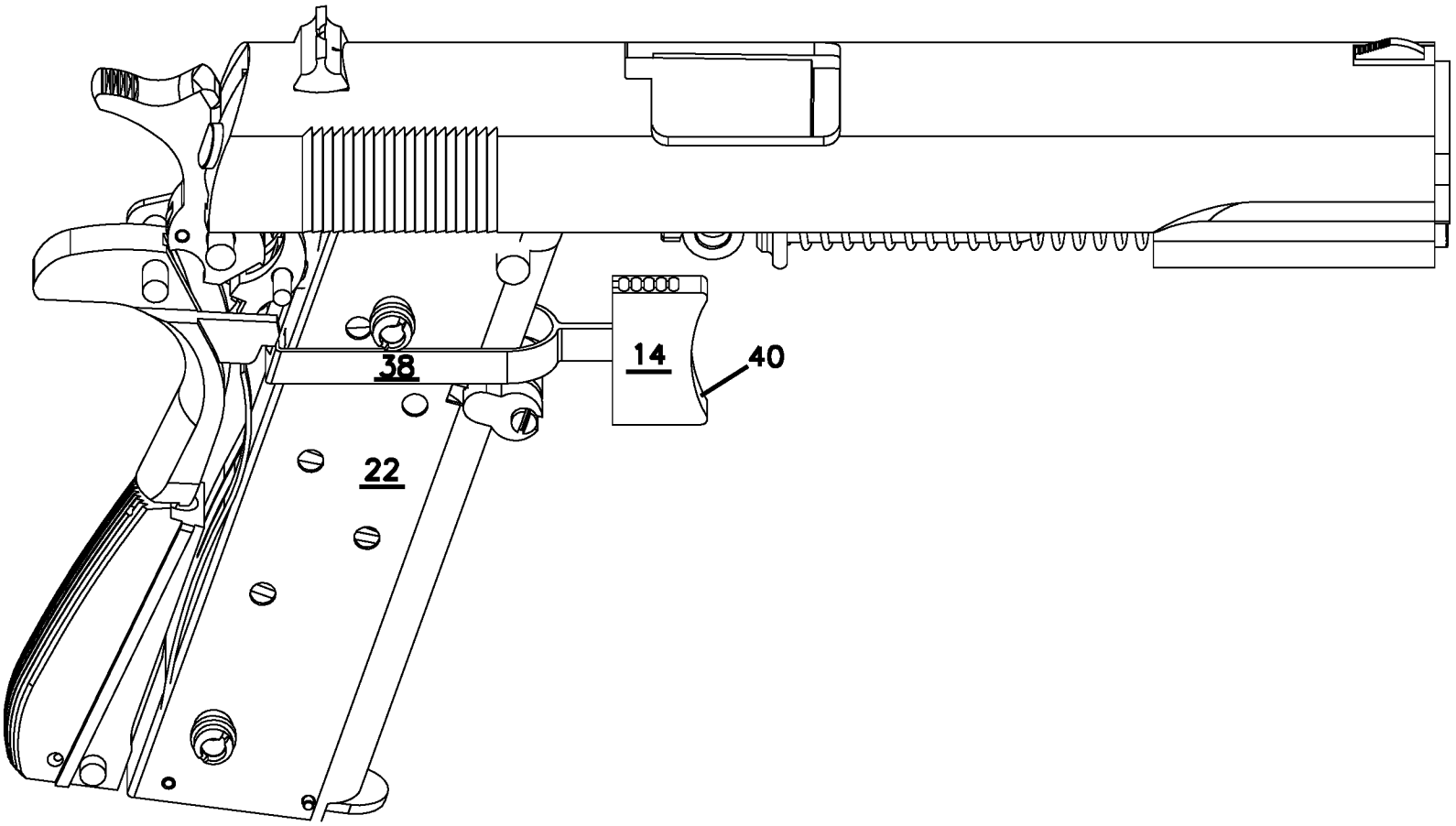
FIG. 4 is a perspective view of the trigger assembly of FIG. 1 positioned in a handgun with portion of the handgun removed for clarity.
Figure 5:
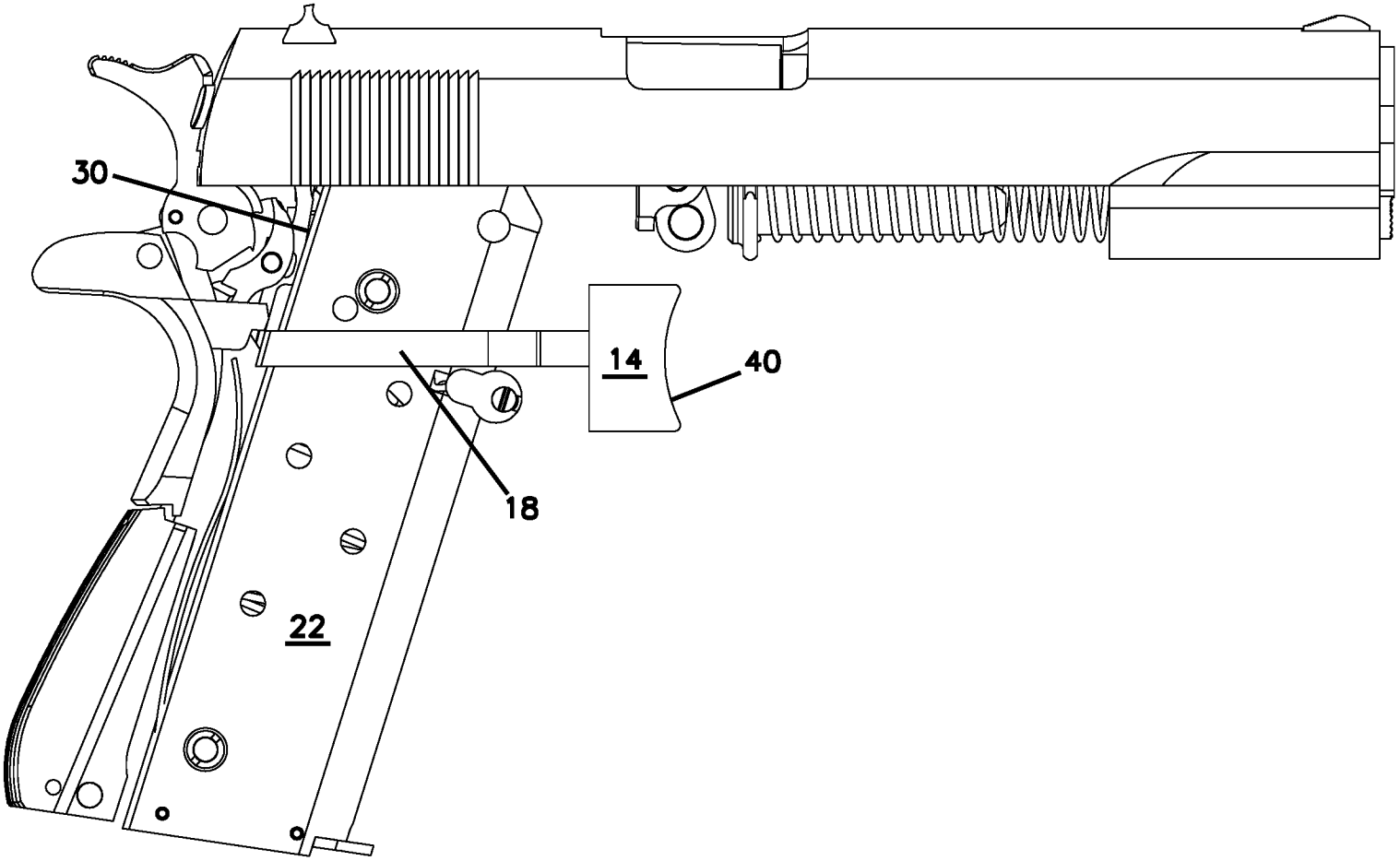
FIG. 5 is a side view of the of the trigger assembly of FIG. 1 positioned in a handgun with portion of the handgun removed for clarity.
Figure 6:
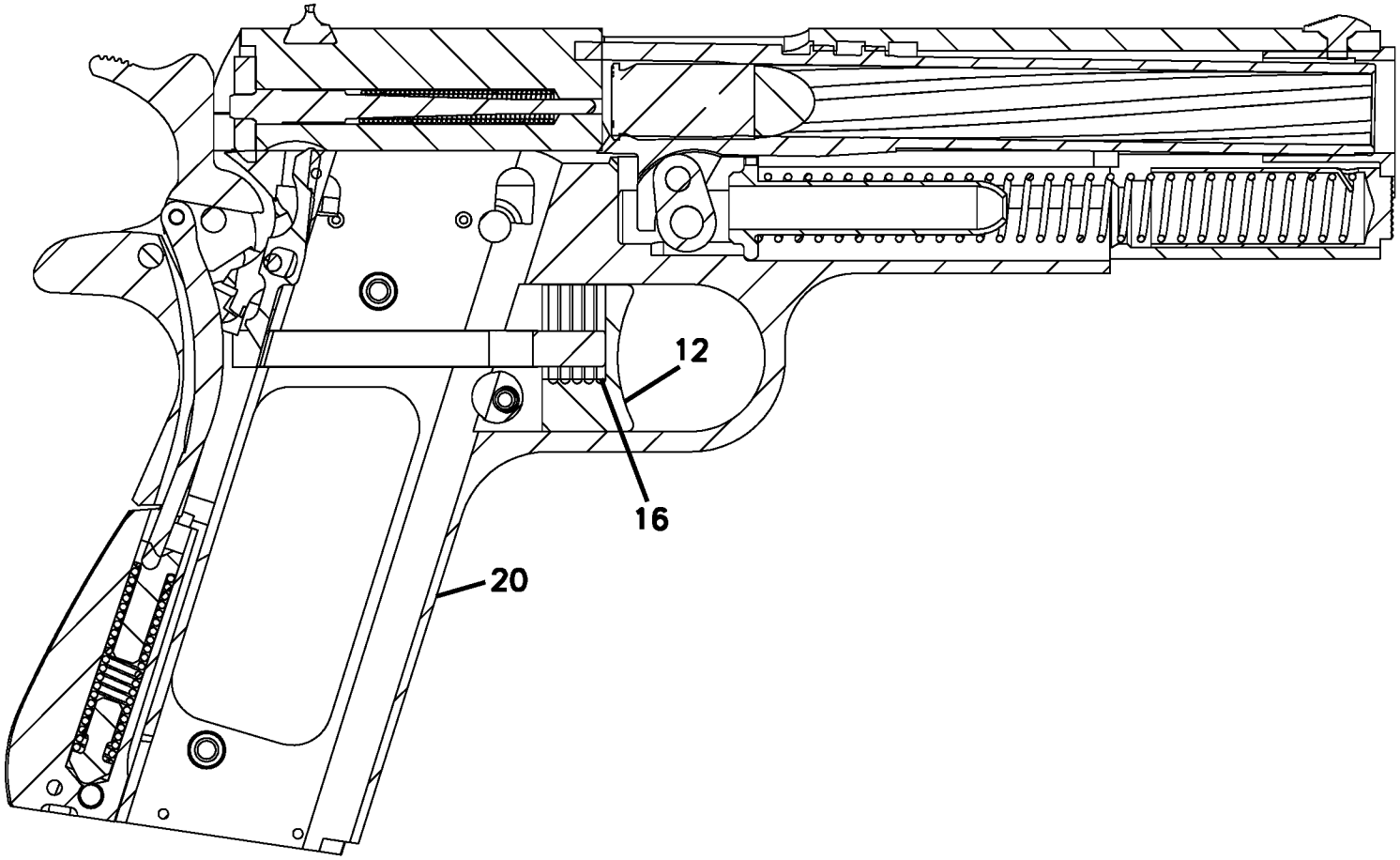
FIG. 6 is side view of the trigger assembly of FIG. 1 first configuration.
Figure 7:
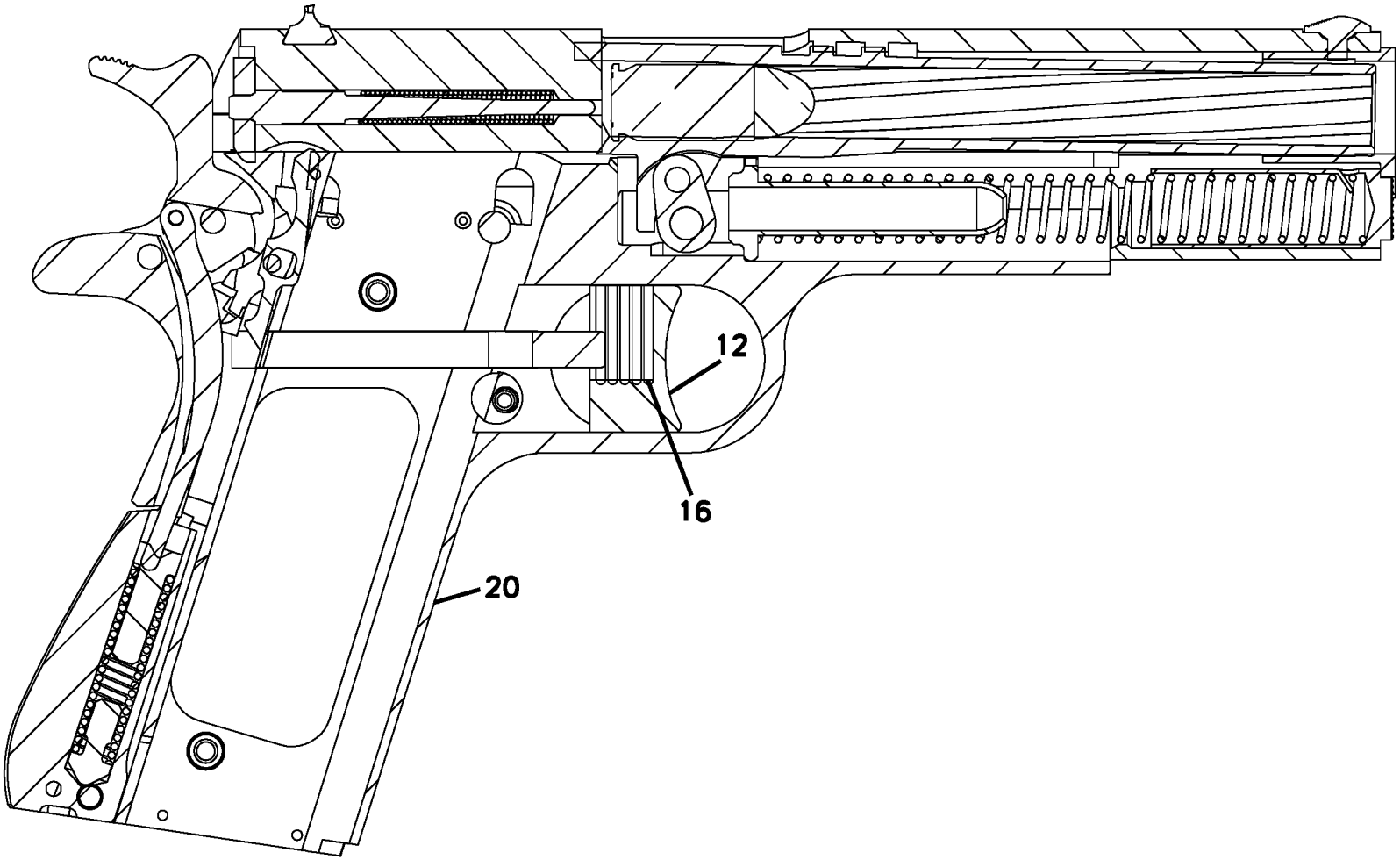
FIG. 7 is side view of the trigger assembly of FIG. 1 second configuration.
Figure 8:
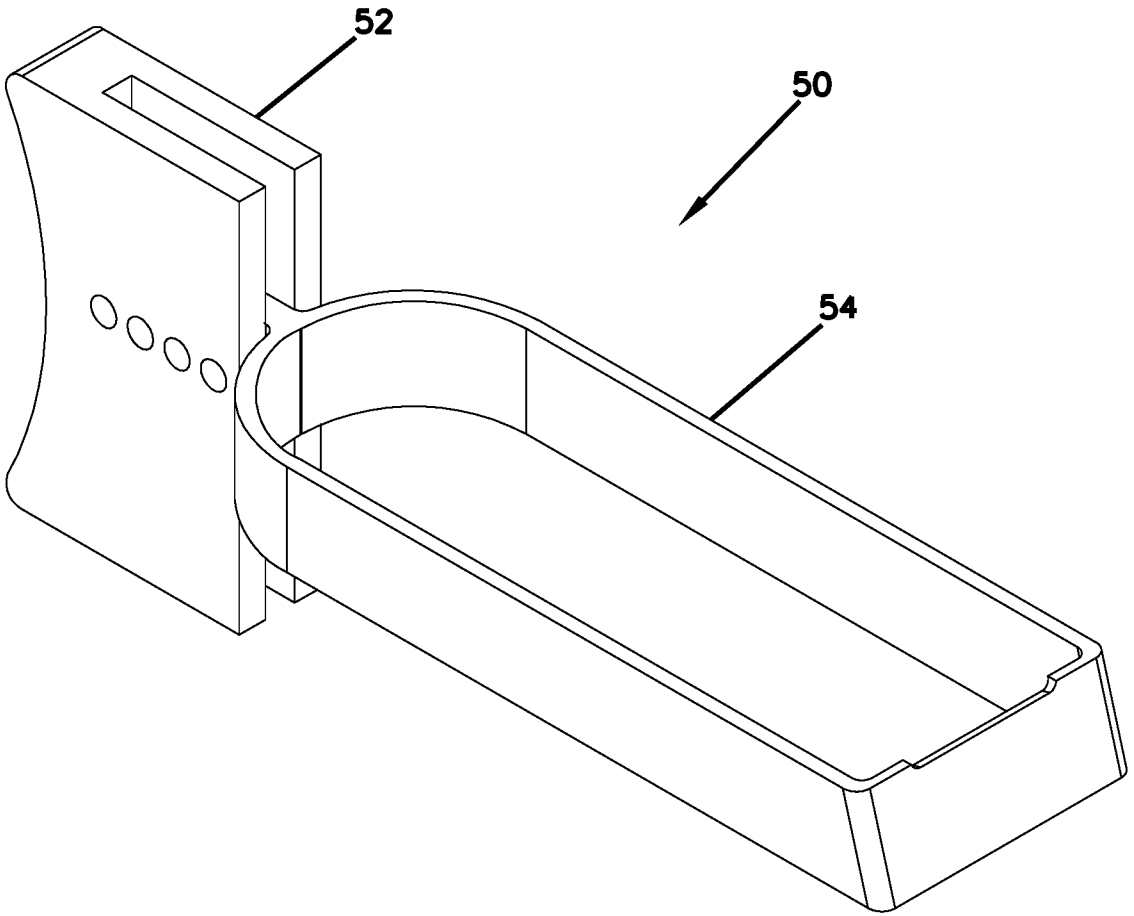
FIG. 8 is a perspective view of an alternative embodiment of the adjustable trigger assembly according to principles of the present disclosure.
Figure 9:
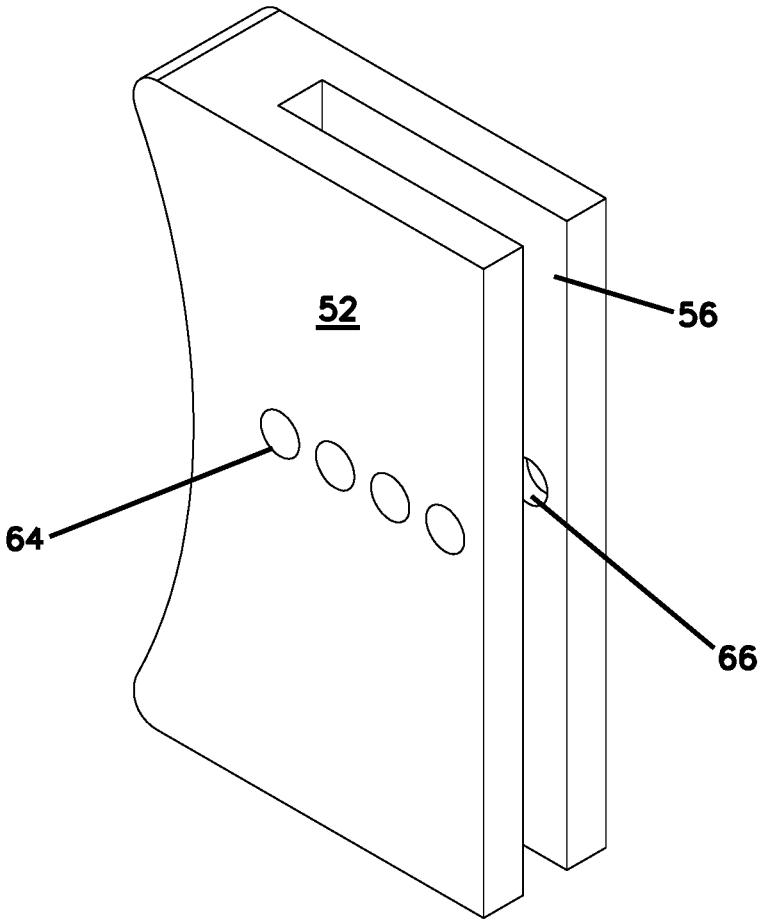
FIG. 9 is a perspective view of a first component of the trigger assembly of FIG. 8.
Figure 10:
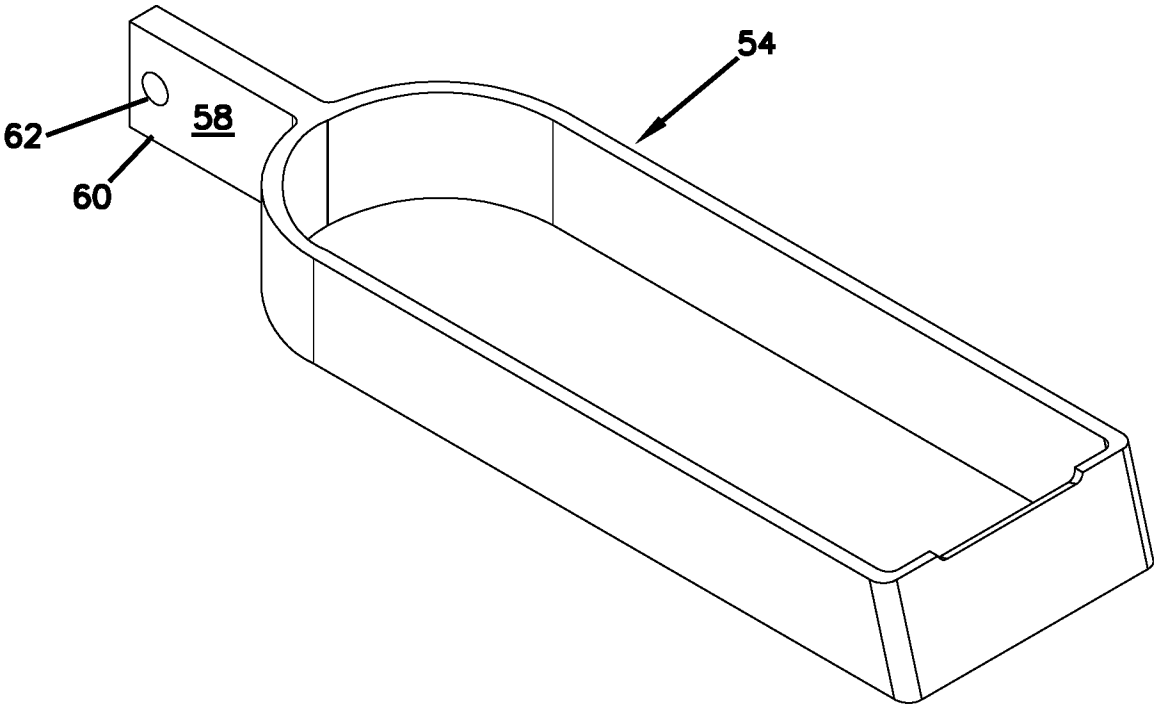
FIG. 10 is a perspective view of a second component of the trigger assembly of FIG. 8.
Figure 11:
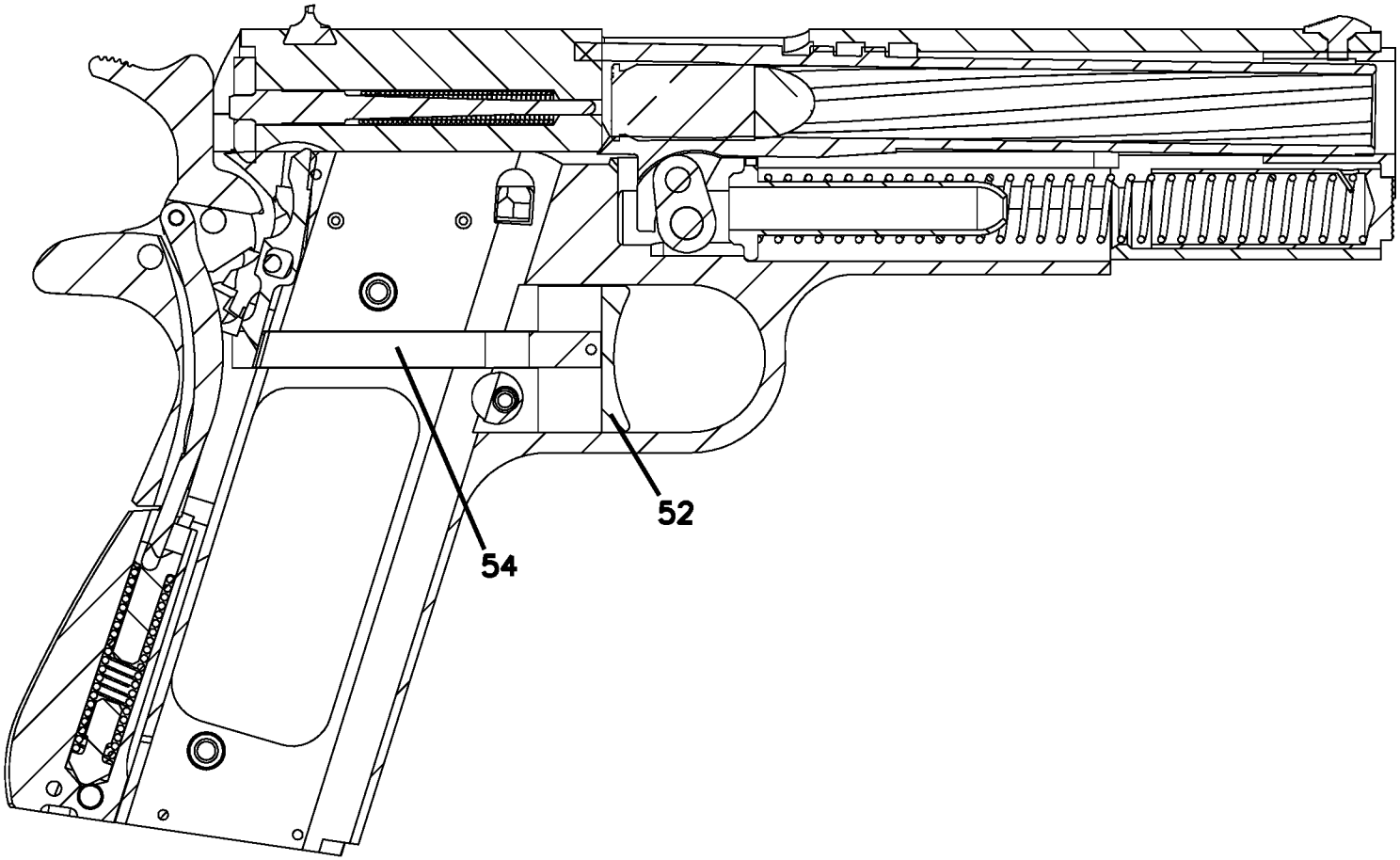
FIG. 11 is side view of the trigger assembly of FIG. 8 first configuration in a handgun with portions of the handgun removed for clarity.
Figure 12:
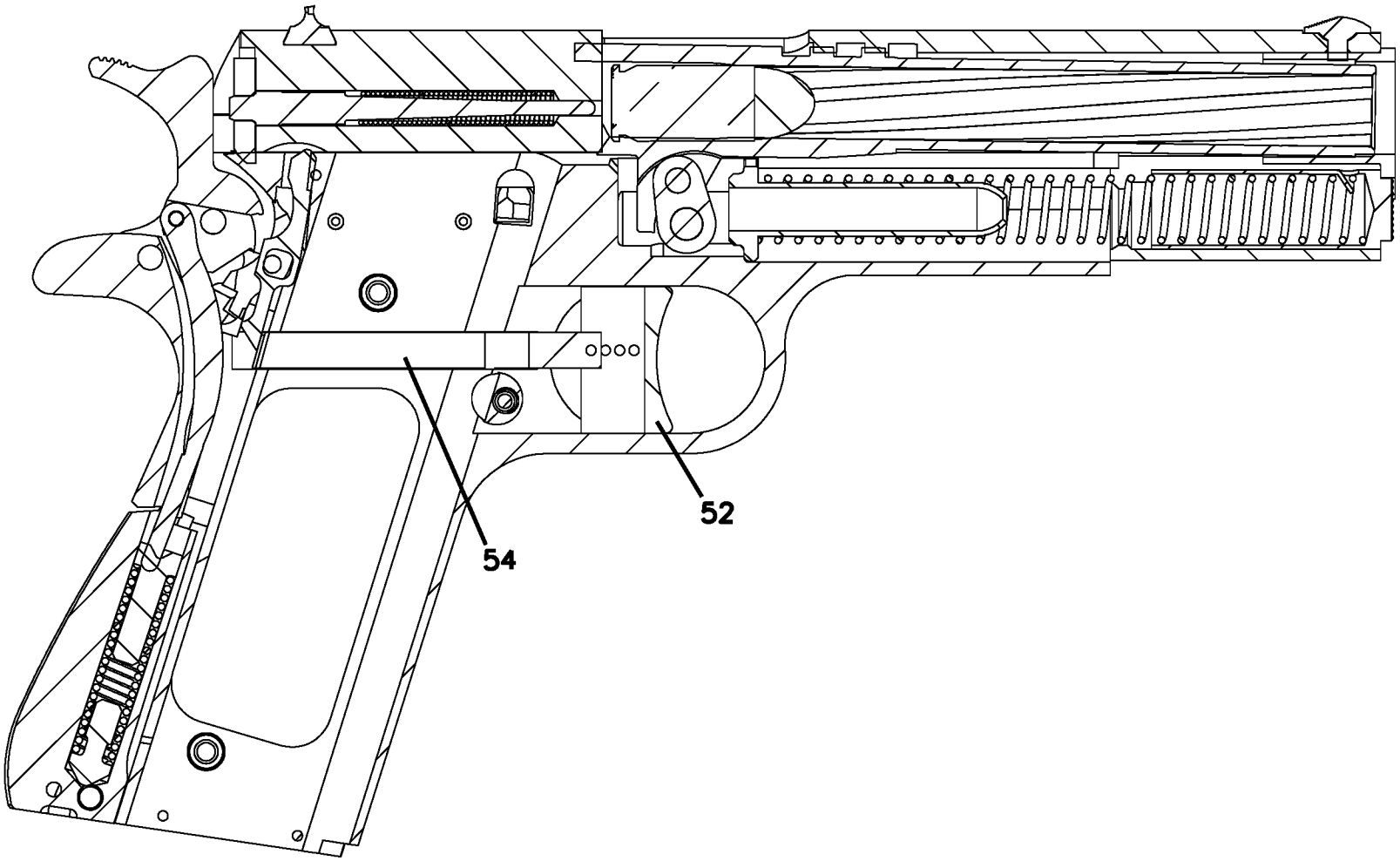
FIG. 12 is side view of the trigger assembly of FIG. 8 second configuration of the trigger assembly of FIG. 1 position in a handgun with portion of the handgun removed for clarity.

In the depicted embodiment, a trigger body that includes a trigger finger engaging surface is configured such that the linkage that connects to the trigger body can be connected to the trigger body at multiple different location thereby providing a mechanism for adjust the resting position of the trigger engaging surface relative to the firearm frame. In the depicted embodiment, the extent that the linkage can extend into the trigger body is adjustable, which adjusts the resting position of the trigger. FIG. 7 depicts an embodiment of the trigger assembly adjusted to fit a shooter with large hand whereas FIG. 8 shows that same trigger assembly adjusted to fit a shooter with a small hand. As can be seen in the FIGS. the trigger body is connected to the linkage at different location within the trigger body to allow for the fit adjustment.

In the depicted embodiment, the adjustable trigger assembly 10 includes a trigger shoe 12 that includes a body 14. The body 10 including a plurality locking catches 16. In the depicted embodiment, the locking catches are spaced apart slots that are connected to a channel 32. The channel 32 is shown as being open to the top of the trigger shoe 12. It should be appreciated that many alternative embodiments are also possible including embodiments wherein the channel is instead a slot or keyway. In the depicted embodiment, the term trigger shoe 12 is used as it is a common term to reference the body of at trigger in a 1911 style handgun. As discussed above, it should be appreciated however that the principles of the present disclosure are applicable to many other styles of firearm. The term trigger body is used herein to generically refer to the structure of a trigger that includes a surface that is configured to engage a shooter's finger. As used herein the term trigger body refers to the structure that is pulled rearward by the shooter's finger to cause the firearm to discharge. In the depicted embodiment, the trigger shoe defines a forward surface that is a curved trigger finger engaging surface 40. In the depicted embodiment, the trigger shoe/trigger body include a flat top surface 42 and a flat bottom surface 44 and is configured to travel forward and rearward in a lateral direction. It should be appreciated that in other alternative embodiments the trigger body may pivot rather than slide forward and rearward.

In the depicted embodiment, the trigger assembly also includes a trigger bow 18 configured to extend through a handle 20 of a firearm and around a top portion of a magazine 22 of a fire arm. The trigger bow 18 including a neck portion 24 and a head portion 26 that is configured to engage and interlock with any one of the plurality of locking catches 16. In the depicted embodiment, the head portion and neck together define a generally T-shaped top profile. In the depicted embodiment, the neck portion 24 wherein the neck portion 24 fits within the channel 32 and the head portion 26 fits into and is captured by any one of the locking catches 16. In the depicted embodiment, the neck and head portion is configured to "drop into" the trigger body (i.e., slide into engagement with the trigger body). It should be appreciated that although the locking catches are shown as vertical slots. In the depicted embodiment, the locking catches are shaped to receive the head portion of the trigger linkage from a first direction and capture the head portion from a second direction. It should be appreciated that the locking catches could alternatively have many other configurations. For example, they could be drilled vertical holes. An additional, configuration for the catches will be discussed in more detail below with reference to FIGS. 8-12.

In the depicted embodiment, the trigger bow 18 includes a back or rear portion 28 that engages a disconnector 30. The disconnector is configured to selectively block or allow rearward motion of the trigger bow 18. In the depicted embodiment, the trigger bow is configured such that in addition to the adjustment of the resting position of the trigger, the travel of the trigger can also be adjusted. In the depicted embodiment, the trigger bow 18 also includes a front portion 34, spaced apart opposed side members 36, 38 connected between the back portion 28 and front portion 34. The neck portion 24 extends forwardly from the front portion. It should be appreciated that many other different linkage configuration are possible other than the above described trigger bow.

In the depicted embodiment, the term trigger bow is used as it is a common term to reference the structure of at trigger in a 1911 style handgun that links the trigger body (e.g., the shoe) to the other firing components located rearward of the clip and partially within the handle. As discussed above, it should be appreciated, however, that the principles of the present disclosure are applicable to many other styles of firearms. The term trigger linkage is used herein to refer generically to structure that mechanically interfaces between trigger body and other firing components of the firearm (e.g., disconnector, sear, hammer, etc.). The term linkage as used herein refers to one or more physical structures that are connected together or arranged to mechanically engage each other (e.g., contact). In the depicted embodiment, the linkage (e.g., the trigger bow) extends through a portion of the trigger body. In the depicted embodiment, the linkage is engaged with the trigger body in that it moves with the trigger body, but is not rigidly connected to it or pinned to it. It should be appreciated that in alternative embodiment the interface could be different. One different connection will be discussed in further detail below with reference to FIGS. 8-12.

Referring to FIGS. 8-12, an alternative embodiment of the trigger assembly is shown. In the depicted embodiment, the trigger assembly 50 includes trigger body 52 and linkage 54 that are similar in structure and function to that of the trigger assembly 10. The difference is that the trigger body includes a slot 56 for receiving the neck portion 58 of the linkage 54. The neck portion 58 terminates in a head portion 60, which includes an aperture 62. The head portion is configured to slide into the trigger body 52 and align with apertures 64 on at least one side portion of the trigger body 52. In the depicted embodiment, the apertures 64 are threaded and configured to receive a bolt that extends through the aperture 62 in the head portion 60 of the linkage. In the depicted embodiment, the end of the bolt extend into a recess 66 in the inside surface of the opposed side of the trigger body that faces the slot. In the depicted embodiment, the linkage is pinned to the trigger body. The locking catches in this embodiment are the aperture 62 combined with the bolt/pin that is configured to be received in the aperture 62. The position of the trigger body in the trigger guard/frame of the firearm can be adjusted by relocating the bolt from one aperture 64 to another aperture in the trigger body. It should be appreciated that many other alternative adjustable trigger configurations according to the principles of the present disclosure exist.

Figure 13:
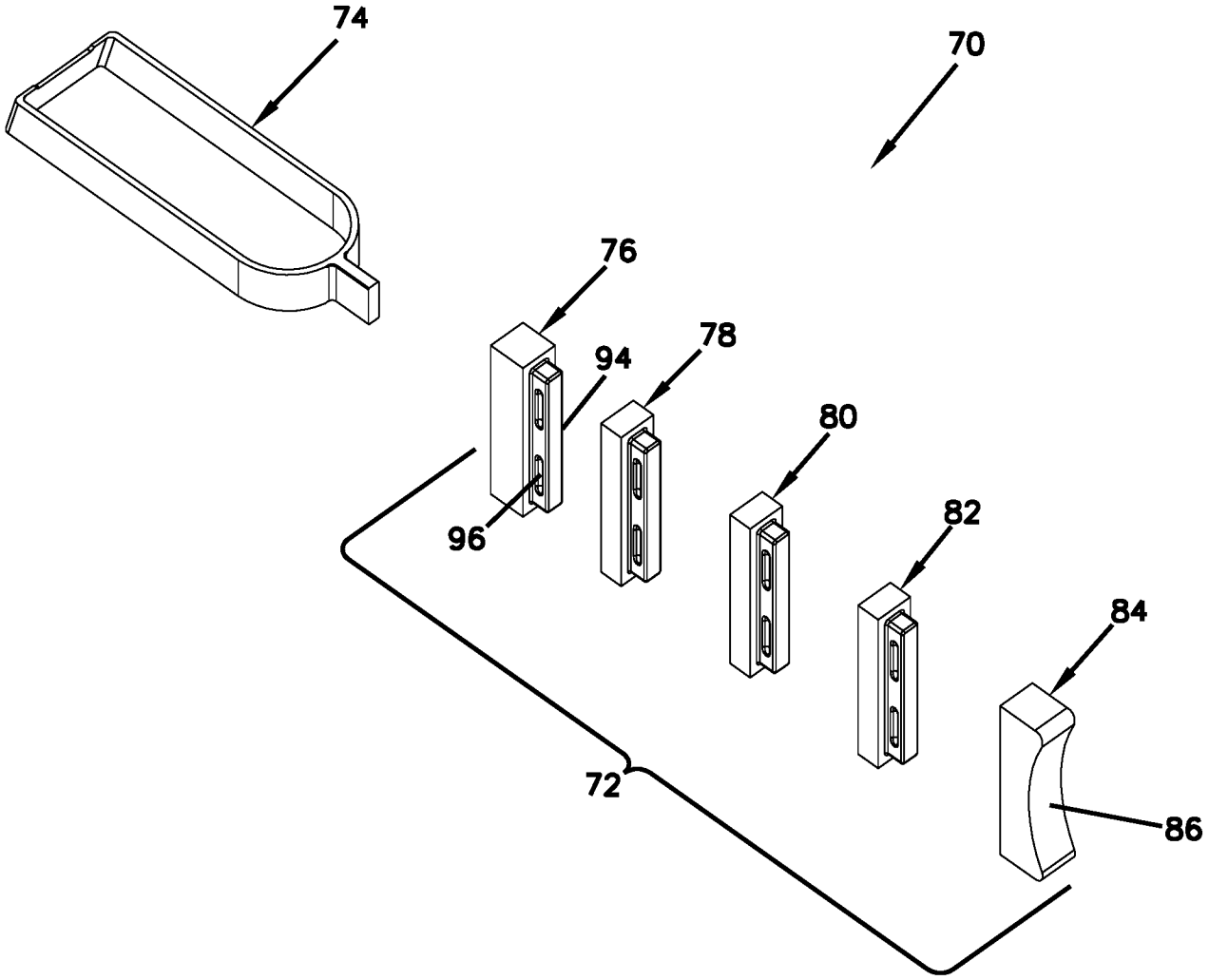
FIG. 13 is a front perspective view of an alternative embodiment of the adjustable trigger assembly according to principles of the present disclosure.
Figure 14:
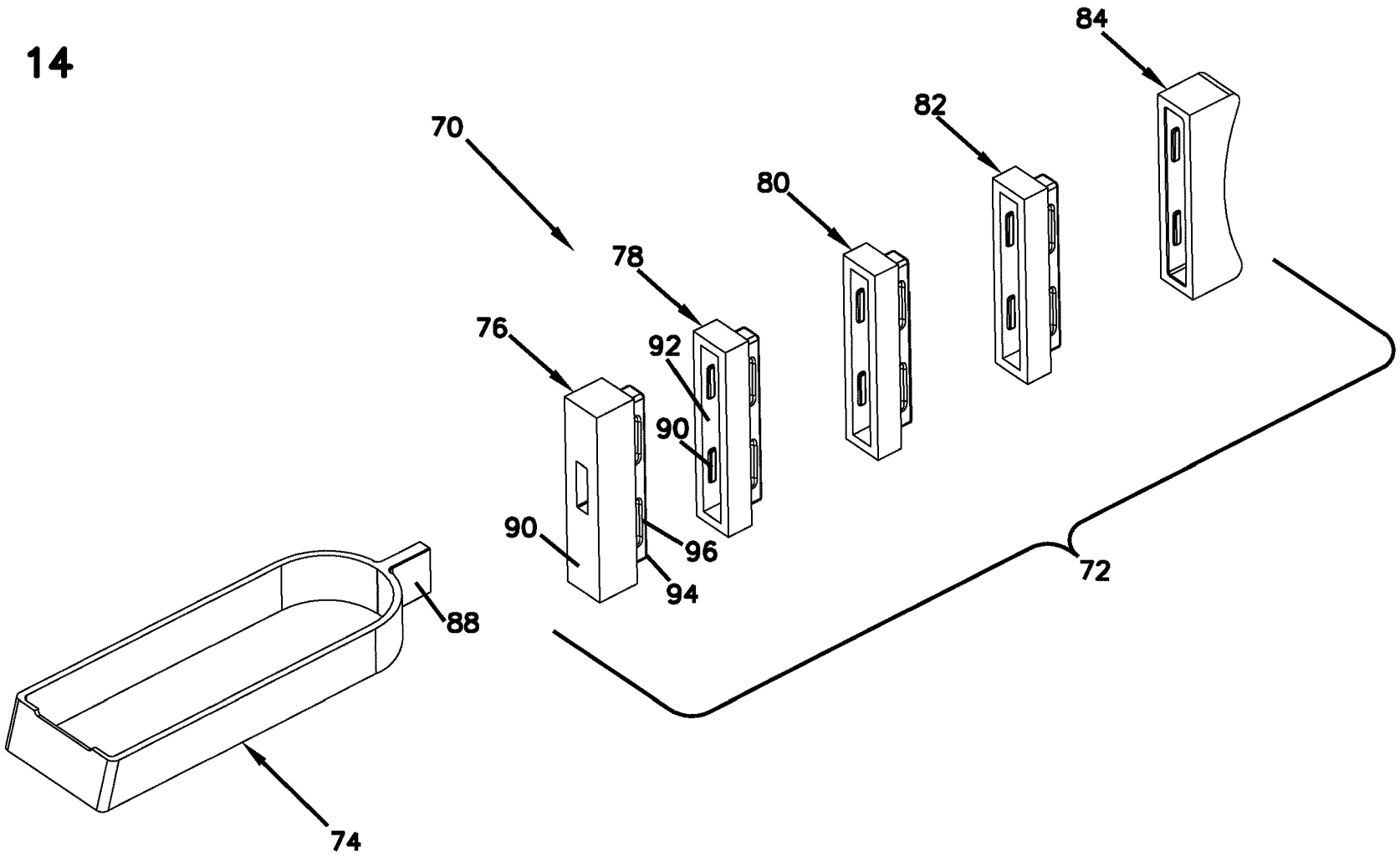
FIG. 14 is a rear perspective view of the trigger assembly of FIG. 13.

Referring to FIGS. 13-14, an alternative embodiment of the trigger assembly is shown. In the depicted embodiment, the trigger assembly 70 includes trigger body 72 and linkage 74 that are similar in structure and function to that of the trigger assembly 10. The difference is that the trigger body includes one or more number of spacers 76-84. In the depicted embodiment, spacer element 84 includes a finger engaging surface 86. In the depicted embodiment, spacer element 76 directly engages and connects to the neck portion 88 of the linkage 74. Spacer elements 76, 80, 82 can be removed or added to adjust the overall length of the trigger body which is defined by the back wall 90 of spacer element 76 and the trigger engaging surface 86. In the depicted embodiment, the spacer elements snap together. Space element 78, for example, has a female end major recessed portion 92 that receives a major protrusion 94. Minor recesses 96 are located on the major protrusion 94 and minor protrusions 98 are located on the major recesses. The minor recesses 96 are configured to receive the minor protrusion 98. This configuration allows for the spacers to be easily added or removed yet the trigger body 72 to have structural integrity an act as a solid unit once assembled. It should be appreciated that many other alternative configuration are also possible.

The present disclosure also provides a method of adjusting the resting or normal location of a trigger. In one embodiment, the method includes the step of disconnecting the trigger body from a linkage that connects the trigger body to a hammer. This step can involve partially disassembling the firearm to remove the trigger assembly from the firearm such as in the embodiment shown in FIGS. 1-7. Alternatively, this step may not require any disassembly of the firearm as in the embodiment shown in FIGS. 8-12. The method can also include the step of reconnecting the trigger body to the linkage that connects the trigger body to a hammer such that the distance between the trigger finger engaging the surface of the trigger linkage is changed. For example, the actual connection point between the trigger body and linkage can be changed from a first location to a second location wherein the second location is different that the first. This step can for example involve connected the linkage to the trigger body at a different location (a different slot engaged with the head of the linkage) than it was previously connected. Alternatively, the step can include aligning and inserting a pin that extend through the trigger body and the linkage though a different aperture in the trigger body. Many other alternative variations for this step exists. For example, in one embodiment, this step involves adding or removing spacers between the trigger finger engaging surface and the linkage. The method can also include the step of reinstalling the trigger assembly into the firearm.

Figure 15:
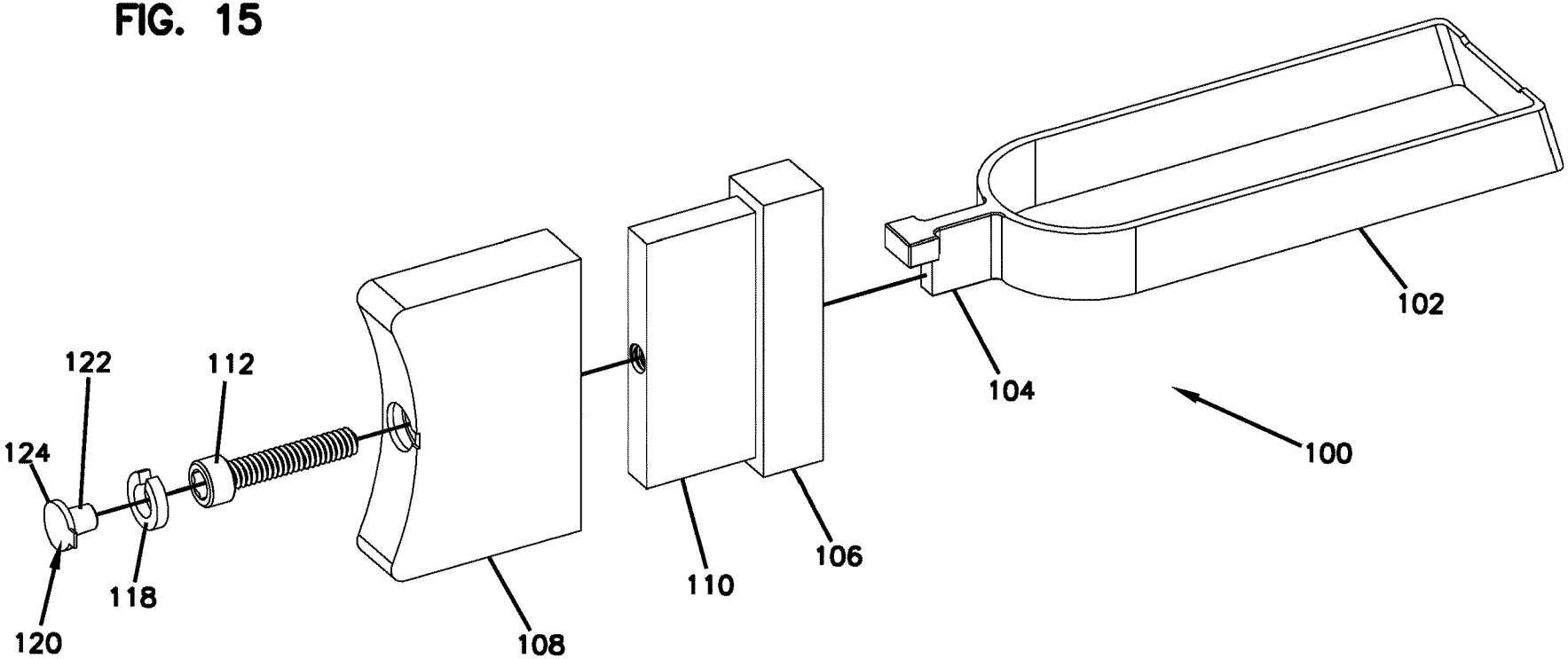
FIG. 15 is an exploded assembly view of an alternative embodiment of the adjustable trigger assembly according to principles of the present disclosure.
Figure 16:
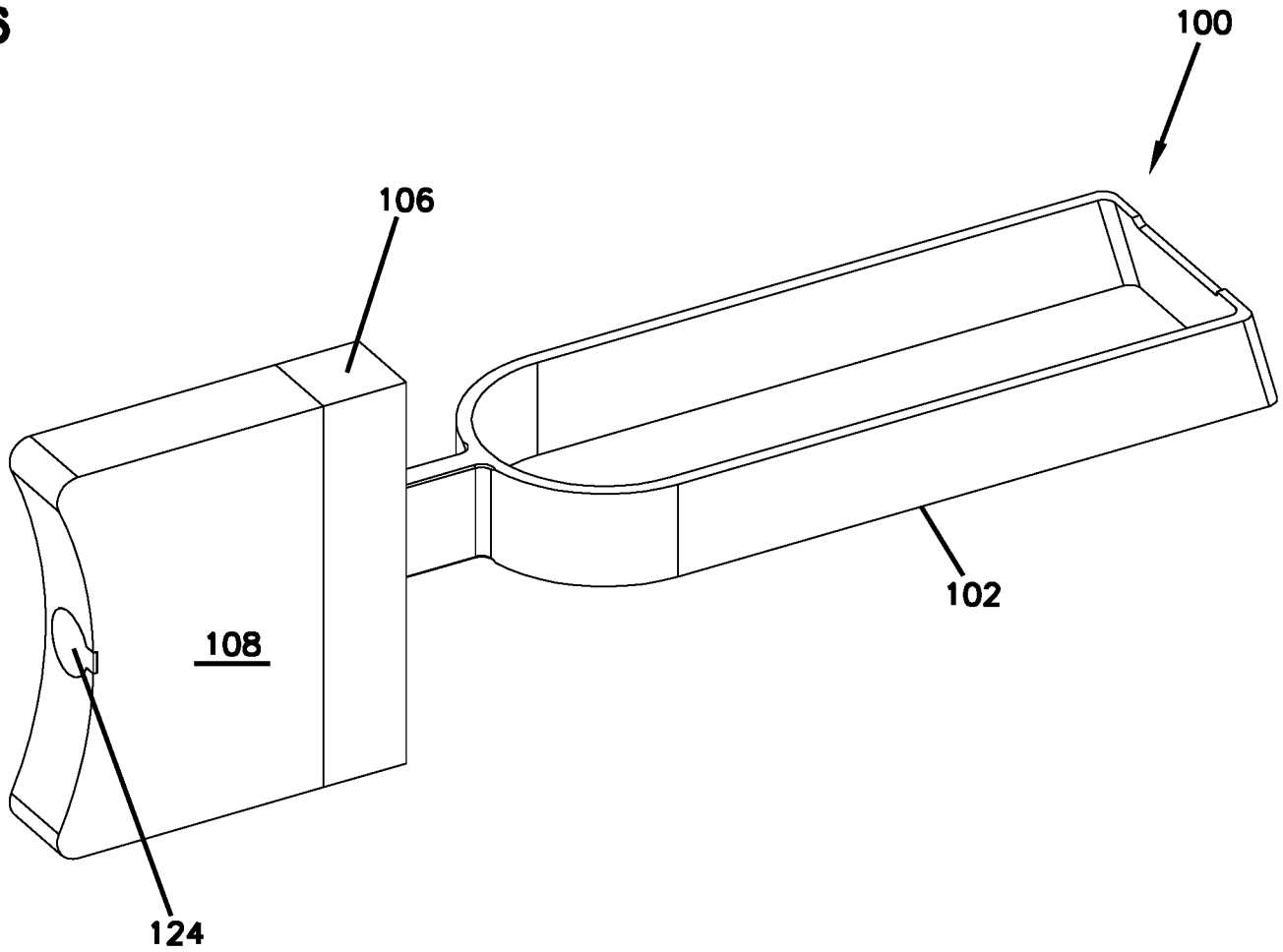
FIG. 16 is an assembled view of the adjustable trigger assembly of FIG. 15.
Figure 17:
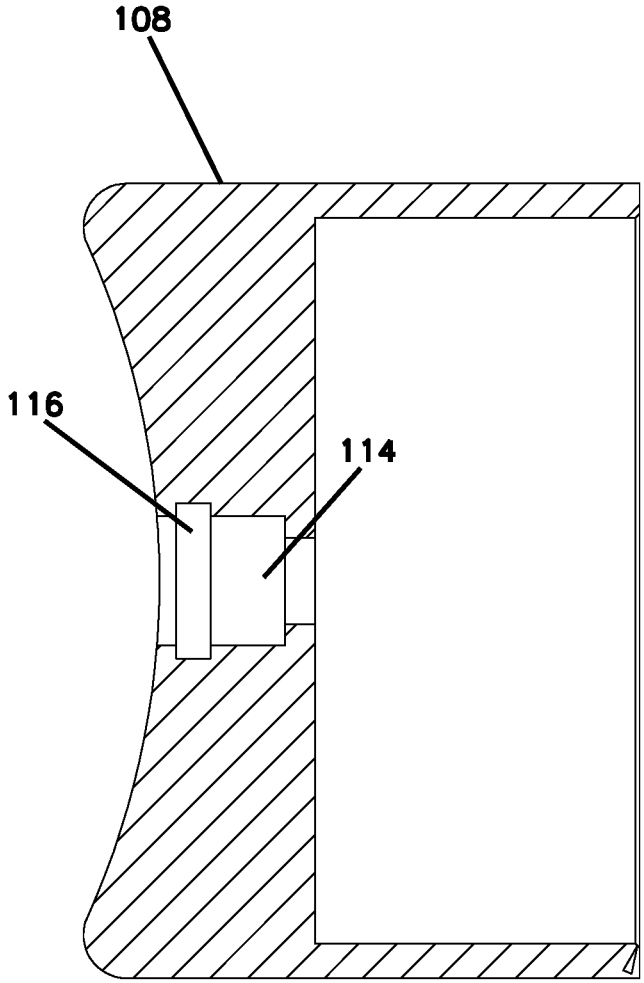
FIG. 17 is a cross sectional view of a component of the adjustable trigger assembly of FIG. 15.

Referring to FIGS. 15-17, an alternative embodiment of the trigger assembly is shown. In the depicted embodiment, the trigger assembly 100 includes a trigger bow 102 that includes a neck portion 104 configured to interlock with a trigger base 106. The trigger assembly 100 includes a trigger shell 108 configured to receive an insertion portion 110 of the trigger base 106. In the depicted embodiment, a threaded bolt 112 secures the trigger shell 108 to the trigger base 106. The threaded bolt 112 also defines the lateral position of the trigger shell 108 relative to the trigger base 106 and also thereby defines the overall length of the trigger shell 108 and trigger base 106 assembly.

In the depicted embodiment, the trigger shell 108 includes an unthreaded aperture 114 for receiving the threaded bolt 112. The aperture 114 include a annular groove 116 that is configured to receive a snap ring 118 that retains the threaded bolt 112 yet allows it to rotate relative to the trigger shell 108 and also allows access to the head of the threaded bolt 112 so that it can be actuated (e.g., via an Allen wrench). In the depicted embodiment, the trigger assembly includes a retaining cap 120 that prevents the threaded bolt 112 from inadvertently rotating during use. The retaining cap 120 includes a first end portion 122 that engage the end of the threaded bolt and a second end portion 124 that engages and interlocks with the trigger shell 108. In the depicted embodiment, when engaged the retaining cap prevents the threaded bolt 112 from rotating and is flush with the front face of the trigger shell.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of providing an adjustable trigger comprising the steps of:

installing an adjustable trigger assembly into a firearm, wherein the adjustable trigger assembly includes:

a trigger bow including a neck portion;

a trigger base interlocked with the neck portion of the trigger bow, the trigger base including an insertion portion;

a trigger shell including a cavity that receives the insertion portion to form a trigger shell and trigger base assembly; and a threaded bolt extending through a portion of the trigger shell and a portion of the trigger base configured and arranged to secure the trigger shell to the trigger base and to define a lateral position of the trigger shell relative to the trigger base; and adjusting the lateral position of the trigger shell relative to the trigger base to achieve a desired overall length of the trigger shell and trigger base assembly by rotating the threaded bolt.

2. The method of claim 1, wherein the reconnecting step includes connected the linkage to the trigger body at a different location than it was previously connected.

3. The method of claim 1, wherein the reconnecting step includes adding or removing spacers between the trigger finger engaging surface and the linkage.

4. The method of claim 1, wherein the trigger shell includes an unthreaded aperture for receiving the threaded bolt and an annular groove.

5. The method of claim 1, wherein the adjustable trigger assembly further comprises:

a retaining cap including a first end portion that engages the end of the threaded bolt and a second end portion that interlocks with the trigger shell.

6. An adjustable trigger assembly installed into a firearm, wherein the adjustable trigger assembly includes:

a trigger bow including a neck portion;

a trigger base interlocked with the neck portion of the trigger bow, the trigger base including an insertion portion;

a trigger shell including a cavity that receives the insertion portion to form a trigger shell and trigger base assembly; and a threaded bolt extending through a portion of the trigger shell and a portion of the trigger base configured and arranged to secure the trigger shell to the trigger base and to define a lateral position of the trigger shell relative to the trigger base, wherein the threaded bolt is rotated to adjust the lateral position of the trigger shell relative to the trigger base to achieve a desired overall length of the trigger shell and trigger base assembly.

7. The adjustable trigger assembly of claim 6, wherein the trigger shell includes an unthreaded aperture for receiving the threaded bolt and an annular groove.

8. The adjustable trigger assembly of claim 6, further comprises:

a retaining cap including a first end portion that engages the end of the threaded bolt and a second end portion that interlocks with the trigger shell.

* * * * *